US006186551B1

(12) United States Patent
Quinn, Sr.

(10) Patent No.: US 6,186,551 B1
(45) Date of Patent: Feb. 13, 2001

(54) BOOK STIFFENER MECHANISM

(75) Inventor: Dennis A. Quinn, Sr., Suffolk, VA (US)

(73) Assignee: DAQ, Inc., Suffolk, VA (US)

( * ) Notice: Under 35 U.S.C. 154(b), the term of this patent shall be extended for 0 days.

(21) Appl. No.: 09/415,487

(22) Filed: Oct. 12, 1999

(51) Int. Cl.[7] ..... B42D 1/00

(52) U.S. Cl. ..... 281/21.1; 281/15.1; 281/29; 402/73

(58) Field of Search ..... 281/33, 15.1, 37, 281/29, 36, 21.1; 402/73, 80 R

(56) References Cited

U.S. PATENT DOCUMENTS

| | | | | |
|---|---|---|---|---|
| 985,237 | * | 2/1911 | Waterhouse . | |
| 3,224,792 | * | 12/1965 | Vernon | 281/33 |
| 5,037,136 | | 8/1991 | McIntire . | |
| 5,445,468 | * | 8/1995 | Pacione | 402/73 |

* cited by examiner

*Primary Examiner*—A. L. Wellington
*Assistant Examiner*—Monica S. Carter
(74) *Attorney, Agent, or Firm*—Birch, Stewart, Kolasch & Birch, LLP

(57) ABSTRACT

A book stiffener of a type having a relatively flat, thin, elongated, rigid rotatable-strip (32) attached by a swivel mechanism (34, 108) to an outside surface of a book cover, also includes an indexing mechanism between the rotatable strip and the book cover for holding the rotatable strip in predetermined angular index positions relative to the book cover. The index positions include a stiffening position in which the rotatable strip extends across hinge seams (24, 26) of front and rear flap covers (18, 20) of the book cover, and a disabled position in which the rotatable strip extends more nearly parallel with a back binding (22) of the book cover so as not to substantially extend across the hinge seams. The indexing mechanism includes protrusions (102, 122) on one of the book cover and the rotatable strip and indentations (104, 124) on the other of the book cover and the rotatable strip, with a protrusion resiliently snapping into an indentation at the index positions.

9 Claims, 5 Drawing Sheets

BOOK STIFFENER MECHANISM

BACKGROUND OF THE INVENTION

This invention relates generally to the art of books and more specifically, to books having mechanisms mounted thereon for stiffening them when they are placed in open configurations. In a sense, this invention relates to the art of lap desks.

A difficulty many people have when using books, especially lose-leaf notebooks, is that front and back flap covers of the books usually rotate freely about hinge seams so that such books are cumbersome when held open in a lap. Similarly, it often occurs that loose-leaf notebooks, when open, extend laterally beyond small work surfaces of desks used in many schools so that front and rear flaps thereof rotate downwardly, offering little or no support for loose-leaf papers in the notebooks. When one works with a loose-leaf notebook on his lap or at a small desk, rear and front flat covers provide little or no support but rather rotate easily about hinge seams beyond a common plane in which they are approximately parallel one with the other.

U.S. Pat. No. 5,037,136 to McIntire discloses a book stiffener for preventing front and rear flap covers from rotating substantially beyond a common plane in which they are approximately parallel with one another. This book stiffener basically includes an elongated, rigid, rotatable strip attached to an outside surface of the book cover by a swivel attachment which allows the rotatable strip to rotate between a stiffening position in which it extends across hinge seams of front and rear flap covers for preventing the front and rear flap covers from rotating substantially beyond the common plane and a disabled position in which it extends more nearly parallel with a back binding so that it does not extend across the hinge seams. Although this book stiffener has proven to be useful, it has the problem that the rotatable strip tends to rotate when it should not. This makes the book stiffener awkward to use and negates some of the usefulness of the book stiffener.

Thus, it is an object of this invention to provide a book stiffener of the type disclosed by McIntire in U.S. Pat. No. 5,037,136, but which has stable fixed positions of its rotatable strip, and yet its rotatable strip can be easily rotated when desired between the stiffening and disabled positions.

Similarly, it is an object of this invention to provide such a book stiffener which is inexpensive to construct, easy to mount on a book and uncomplicated to use.

SUMMARY OF THE INVENTION

According to principles of this invention, a book stiffener of a type involving a relatively flat, thin, elongated, rigid rotatable strip attached by a swivel mechanism to an outside surface of a book cover, also includes an indexing mechanism between the rotatable strip and the book cover for holding the rotatable strip in predetermined angular index positions relative to the book cover. The index positions include a stiffening position in which the rotatable strip extends across hinge seams of front and rear flap covers of the book cover so that the flap covers are prevented from being opened beyond a plane, and a disabled position in which the rotatable strip extends more nearly parallel with a back binding of the book cover so as not to substantially extend across the hinge seams. The indexing mechanism includes a protruding member on one of the book cover and the rotatable strip and an indentation on the other of the book cover and the rotatable strip, with a protruding member snapping into an indentation at the index positions.

BRIEF DESCRIPTION OF THE DRAWING

The invention is described and explained in more detail below using the embodiments shown in the drawings. The described and drawn features can be used individually or in preferred combinations in other embodiments of the invention. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
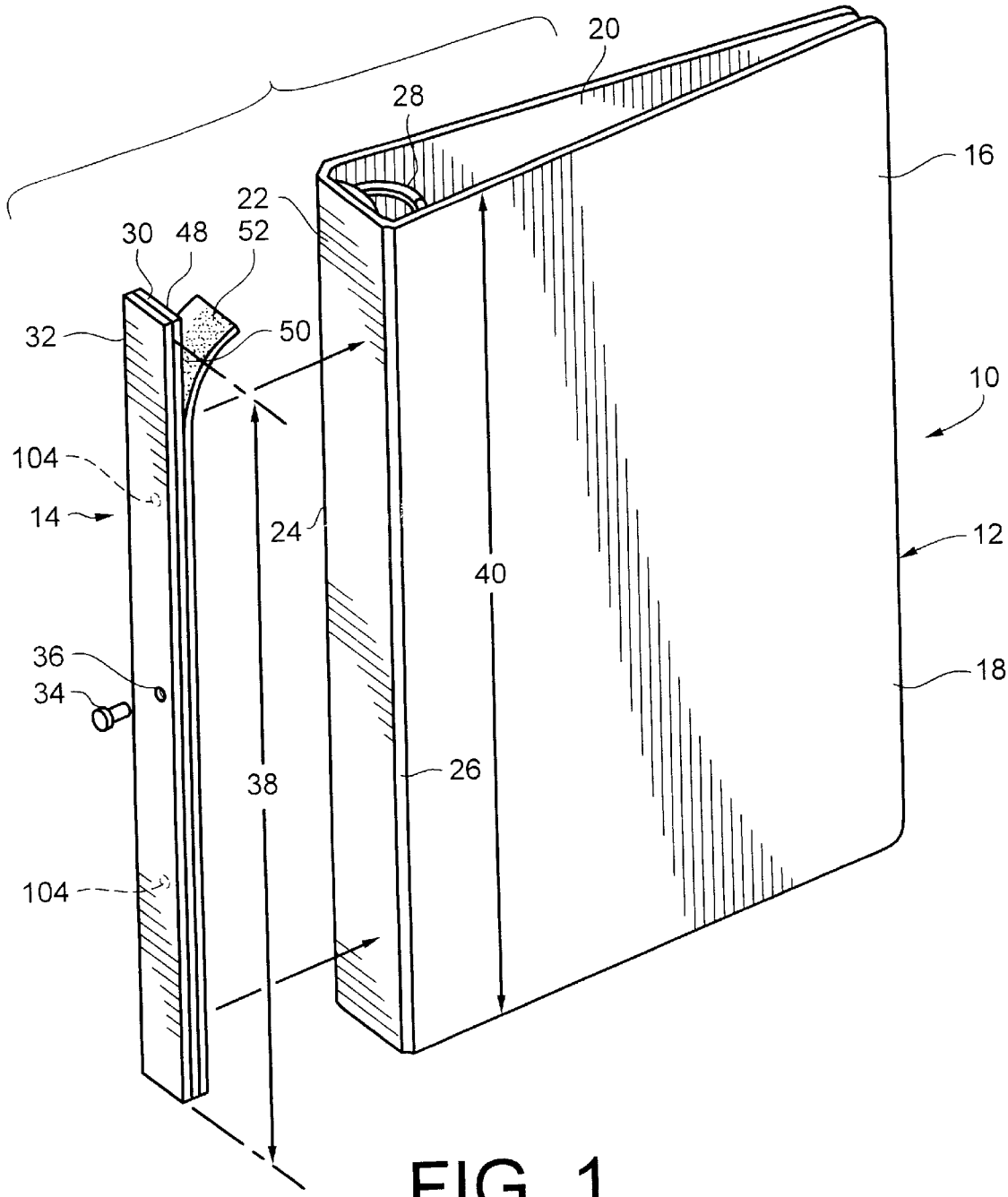
FIG. 1 is an exploded isometric view of a loose-leaf notebook with a first-embodiment book stiffener of this invention.

A stiffened book assembly 10 of FIG. 1 comprises a loose-leaf notebook 12 and a book stiffener mechanism 14.

The loose-leaf notebook 12 has a cover 16 which includes a front flap cover 18, a rear flap cover 20 and an elongated back binding 22. The back binding 22 is respectively attached to the front and rear flap covers 18 and 20 at hinge seams 26 and 24 which allow the respective front and rear flap covers 18 and 20 to pivot thereabout relative to the back binding 22, approximately 180 degrees from the positions shown in FIG. 1. Thus, when a user thereof opens the lose-leaf notebook 12 on his or her lap or on a small desk in order to write on papers 27 clipped to openable rings 28, the front and rear flap covers 18 and 20 provide little support therefor, flopping to positions rotated far beyond a plane of the back binding 22.

Figure 2:
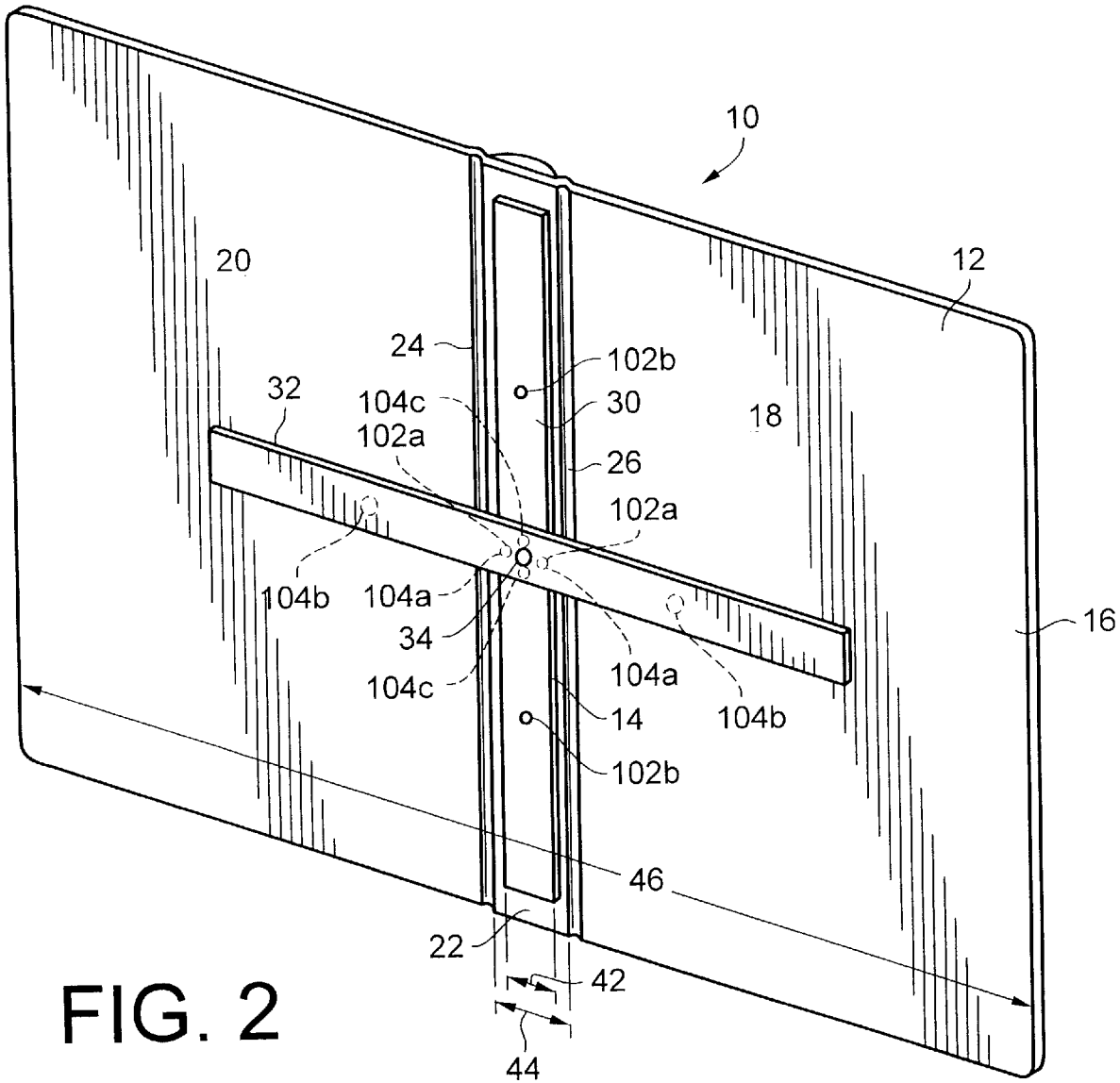
FIG. 2 is an isometric rear view of the structure of FIG. 1 with the book stiffener being attached to the notebook and being in a stiffening position.

The book stiffener mechanism 14 shown in FIGS. 1–4 comprises a relatively flat, thin, elongated, rigid, mounting strip 30; a relatively flat, thin, elongated, rigid, rotatable strip 32; and a swivel attachment 34 which, in a preferred embodiment, includes a rivet, or pin having a shaft passing through coincident holes 36 located approximately at midpoints of the mounting and rotatable strips 30 and 32. In this regard, once the rivet 34 is passed through the holes 36, an end thereof is flattened, or a retainer is placed on the end, so as to cooperate with an opposite-end head for holding the strips together while allowing them to rotate about the rivet, or pin, relative to one another in approximately parallel planes. In one embodiment, the mounting and rotatable strips 30 and 32 are equal in width and length, however, this is not necessary for proper functioning of this invention. In another embodiment, the length of the mounting strip 30 is only a small fraction of that of the rotatable strip. The lengths 38 of the strips 30, 32 should be less than a height 40 of the cover 16. Further, if it is intended to mount the book stiffener mechanism 14 on the back binding 22, as is depicted in FIG. 2, it is helpful if the mounting and rotatable strips 30, 32 have a width 42 which is less than a width 44 of the back binding 22. It is also helpful if the rotatable strip 32 has a length 38 which is less than a total width 46 of the lose-leaf notebook 12 when it is in an open configuration, as is shown in FIG. 2.

The mounting and rotatable strips 30 and 32 can be constructed of the same material or different materials. Some materials which have been used include wood and rigid resinous plastics such as acrylics. Metal will also work. In one embodiment, both the mounting and rotatable strips 30 and 32 are 11 inches in length and 1 ½ inches in width. Also, in one embodiment these members together are 3⁄16 inch thick, with the mounting strip 30 being 1⁄16 inch thick and the rotatable strip 32 being 2⁄16 inch thick.

In FIG. 1, an adhesive surface 48 of the mounting strip 30, which is facing away from the rotatable strip 32, has a pressure sensitive, self-adhering adhesive 50 thereon which, prior to use of the book stiffener mechanism 14, is covered by an adhesive disabling cover 52. It should be understood that an adhesive attachment is disclosed as one possible attachment, but that there are many other possibilities. In some cases, adhesive attachments have been insufficiently strong, Thus, rivet and other attachments have been necessary.

All of the structure described above was also basically described in U.S. Pat. No. 5,037,136 to McIntire. However, the invention of this application adds to this structure an indexing mechanism shown in FIG. 2. This indexing mechanism includes protrusions 102*a,b* on the mounting strip 30 and indentations 104*a,b,c* on the rotatable strip 32. The protrusions 102*a,b* and the indentations 104*a,b,c* are respectively on side surfaces of the mounting and rotatable strips 30 and 32 which face one another when these members are held together by the swivel attachment 34 and they are also aligned with one another so that the rotatable strip can be rotated to angular positions in which the protrusions 102*a,b* resiliently snap into the indentations 104*a,b,c*. In the embodiment depicted in FIG. 2, this resiliency is provided by the mounting and rotatable strips 30 and 32 themselves, the protrusions 102 and the indentations 104 being spaced from the swivel attachment 34. The indentations 104 can be holes passing completely through the rotatable strip 32.

In the stiffening, second-index, position of the rotatable strip 32 shown in FIG. 2, the protrusions 102*a* are resiliently snapped, or engaged, into the indentations 104*a*. In this stiffening position, the interlocking of the protrusions 102*a* and the indentations 104*a* hold the rotatable strip 32 at a 90 degree angle to the mounting strip 30. However, the "hold" of this interlocking can be easily overcome by manually applying force to rotate the rotatable strip 32 so that the protrusions 102*a* disengage from the indentations 104*a*. When the mounting strip 30 and the rotatable strip 32 are align with each other, in a disabled, second-index, position, the protrusions 102*b* snap resiliently into indentations 104*b* and the protrusions 102*a* into indentations 104*c* for holding the rotatable strip 32 in this new disabled, index position. Again, the rotatable strip 32 can be moved from this index position by application of manual force.

Figure 3:
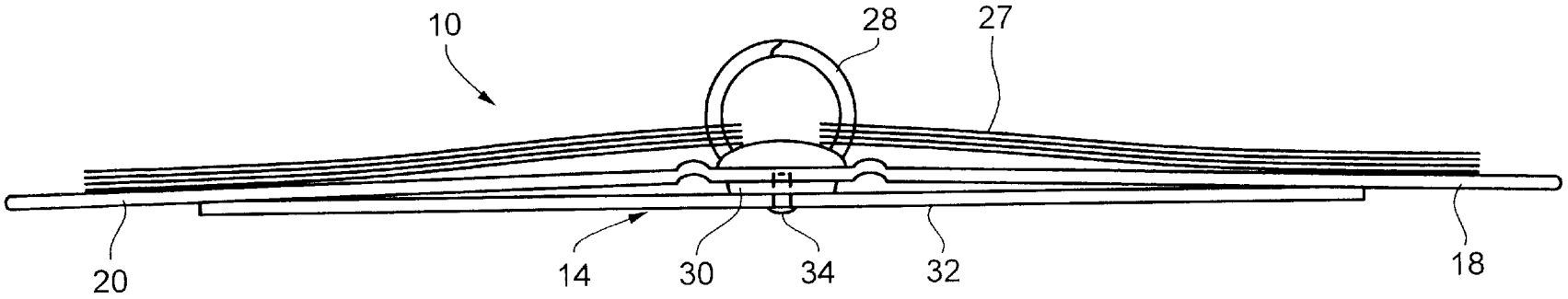
FIG. 3 is a top end view of the structure of FIG. 2.

Describing operation of the stiffened book assembly of FIGS. 1–3, the lose-leaf notebook 12 is constructed separately from the back stiffener mechanism 14. In fact, these items can be sold separately and mated by a user, although they can also be mounted during manufacture of a notebook. To mount the back stiffener mechanism 14 on the cover 16, the mounting strip 30 is rigidly attached to the back binding 22. In the depicted arrangement, this can be done, as shown in FIG. 1, by removing the adhesive disabling cover 52 from the pressure-sensitive adhesive 50 on the adhesive surface 48 and pressing this surface against an outside surface of the back binding 22 so as to fixedly attach the mounting strip 30 on the back binding 22, parallel thereto. Again, this mounting of the mounting strip can be done by rivets and other attaching mechanisms, and adhesive need not the used. Once mounted, the rotatable strip 32 can be rotated about the rivet 34, which holds the mounting and rotatable strips 30 and 32 together. In fact, in one embodiment, this rivet 34 is used to help attach the stiffener mechanism 14 to the back binding 22. Rotational movement of the rotatable strip 32 can be caused between the first-index position, which is the disabled position in which the rotatable strip 32 is aligned with the mounting strip 30 as is shown in FIG. 1, and the second-index position, which is the stiffening position in which the rotatable strip 32 is approximately perpendicular to the mounting strip 30 as is depicted in FIG. 2. In each of the first- and second-index positions, that is the disabled and stiffening positions, protrusions 102 of the mounting strip 30 are snapped into indentations 104 of the rotatable strip 32 for holding the rotatable strip 32 in these first- and second-index positions unless a sufficiently great force is applied to the rotatable strip 32 to overcome the interlocking of the protrusions and indentations. Between the first- and second-index positions the rotatable strip 32 can be rotated with substantially less force than is required to dislodge the protrusions from the indentations.

As can be seen in FIG. 3, when the rotatable strip 32 is snapped into the second-index, stiffening, position, rear surfaces of the front and rear flap covers 18 and 20 impinge upon outer tips of the rotatable strip 32 to be held in a fully open position in which they lie approximately in a common plane with each other and also with the back binding 22. In this respect, it can be seen in FIG. 3 that the front and rear flap covers 18 and 20 and the back binding 22 do not lie exactly in the same plane because of the geometry of the various parts, however, they do lie in planes quite close to one another. In this second-index, stiffening, position, the rotatable strip 32 extends across the hinge seams 26 and 24 to thereby impinge upon the front and rear flap covers 18 and 20 when they are opened to prevent them from being opened substantially beyond a plane of the rotatable strip 32, which is quite close to a common plane in which the front and rear flap covers 18 and 20 and the back binding 22 lie. When it is desired to close the notebook 12 for storing or transporting it, the rotatable strip 32 is rotated to the first-index, disabled, position shown in FIG. 1 in which it is aligned with the mounting strip 30 and the back binding 22 and does not extend beyond the hinge seams 24 and 26 nor end edges of the back binding 22. In other words, it is fully out-of-the-way.

Figure 4:
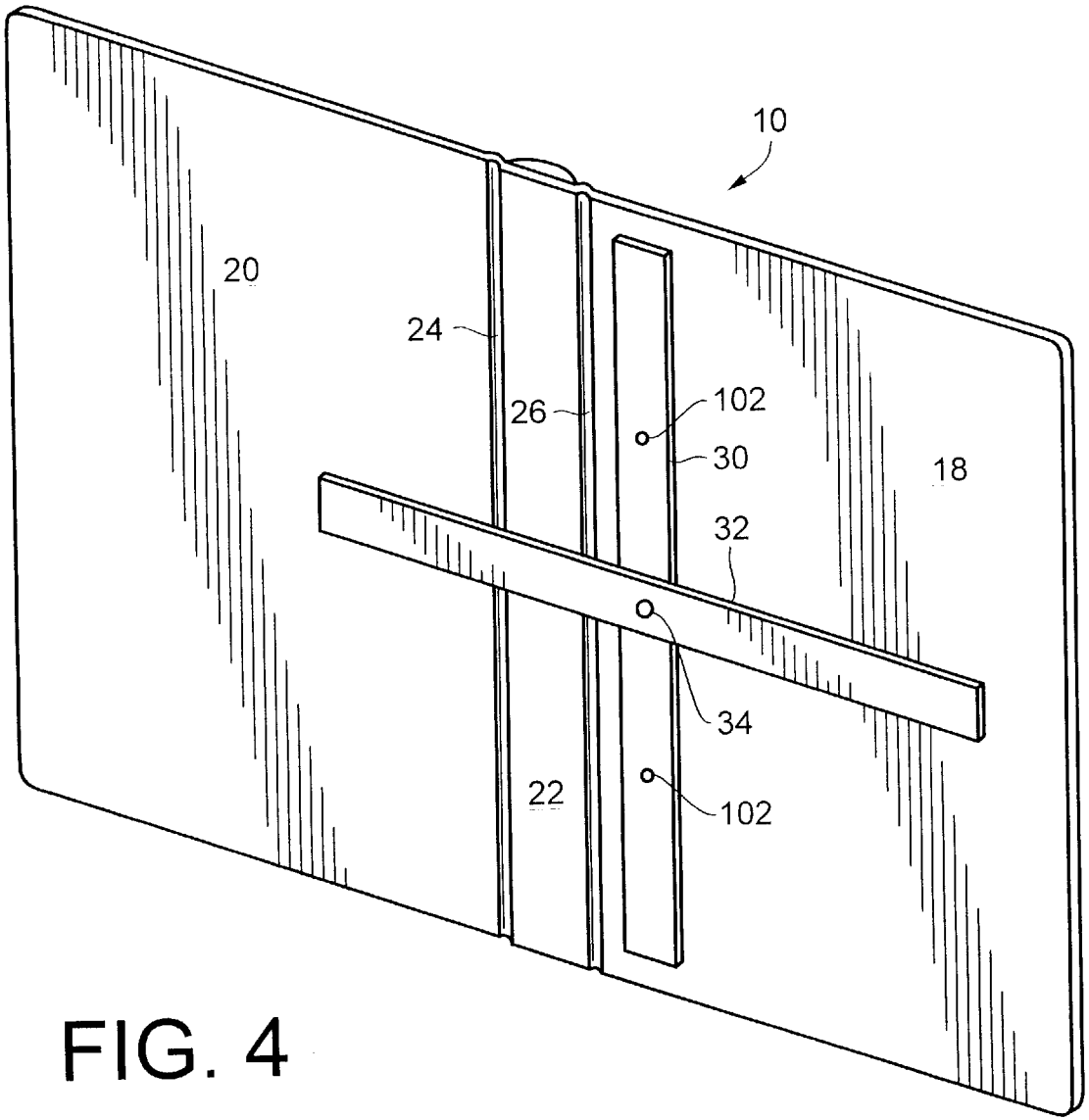
FIG. 4 is an alternate embodiment of the structure of FIGS. 1 and 2, with the book stiffener being mounted at a different location on the book.

Another embodiment similar to the FIGS. 1–3 embodiment is depicted in FIG. 4 in which the mounting strip 30 is not mounted on the back binding 22, but rather, is mounted on a rear surface of the front flap cover 18. It can be seen in FIG. 4 that in this configuration the rotatable strip 32 can still be rotated to extend across the hinge seams 24 and 26 so as to impinge on rear surfaces of the front and rear flap covers 18 and 20 for stabilizing or stiffening the flap covers in attitudes in which they are approximately in a common plane. Again, the indexing protrusions 102 on the mounting strip 30 cooperate with indexing indentations on the rotatable strip 32 which cannot be seen in FIG. 4. It should be understood that the mounting strip 30 and rotatable strip 32 shown in FIG. 4 have the same indexing protrusions and indentations as are shown for these two members in FIG. 2. Further, as has already been noted, such indexing protrusions and indentations can have various arrangements in addition to those depicted in FIGS. 2 and 4 and can be interchanged between the mounting and rotatable strips 30 and 32. Again, in this embodiment the stiffener mechanism 14 can be attached to the notebook in a factory.

Figure 5:
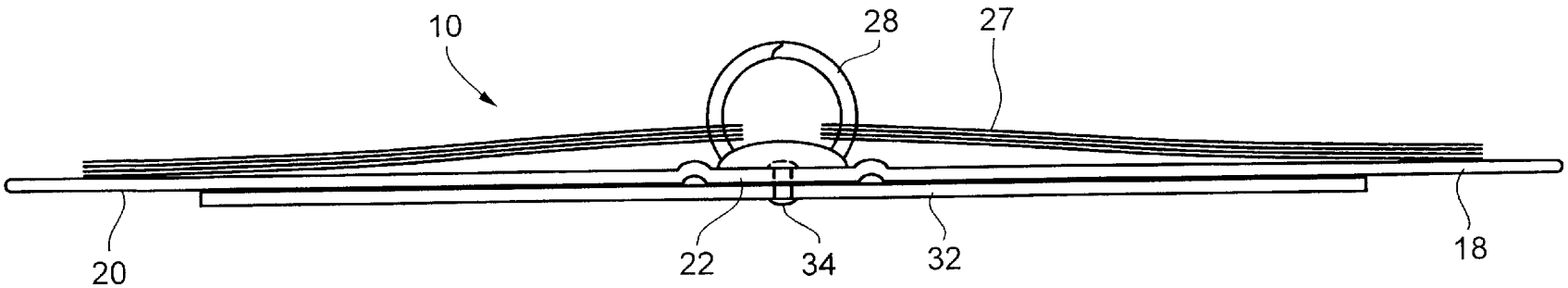
FIG. 5 is a top end view of an alternate embodiment of this invention in which a rotatable strip of a book stiffener is rotatably mounted directly to a back binding of a lose-leaf notebook.

In the embodiment of FIG. 5, the rotatable strip 32 is mounted directly to the back binding 22 by means of a rivet 34 rather than being attached to the mounting strip 30 which is, in turn, attached to the back binding 22. It has been found that this embodiment of the invention appears to work best. In this embodiment, a stiffened book assembly 10 is constructed at a factory, with the book stiffener mechanism 14 not being sold separately from the cover 16. Otherwise, the rotatable strip 32 of FIG. 5 functions in the same manner as it functions in the FIGS. 1–3 embodiment, with the exception that it tends to stiffen the front and rear flap covers 18 and 20 yet nearer to a common plane because a thickness dimension of the mounting strip 30 is not between the back binding 22 and the rotatable strip 32. Another difference is that in this embodiment indexing protrusions and indentations cannot normally be made directly in the book cover 18, 20, and 22 because the book cover is normally not made of a sufficiently hard material. Thus, in one such embodiment, the indexing mechanism can be included as part of a swivel attachment 106 as is depicted in FIG. 6.

Figure 6:
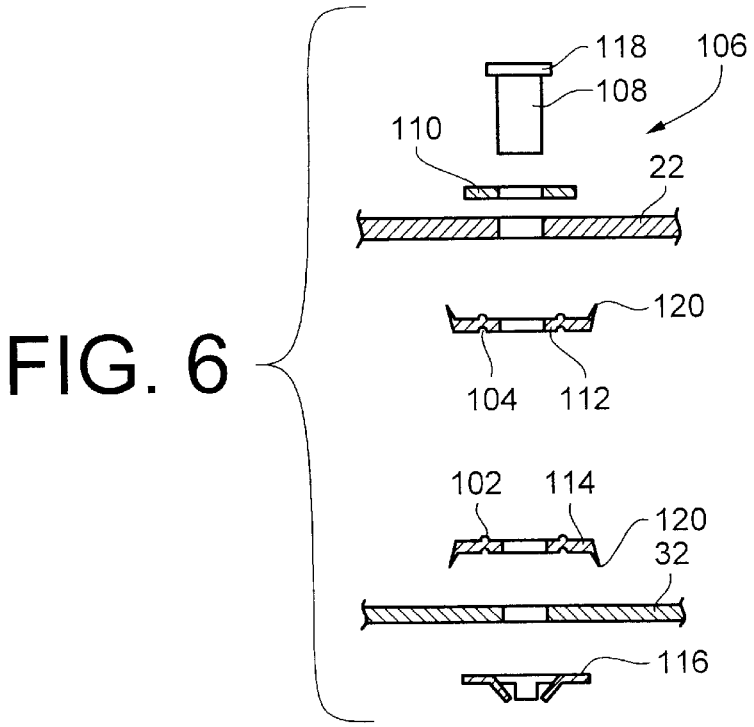
FIG. 6 is an exploded sectional view o f a swivel attachment including an indexing mechanism of this invention, along with fragmented portions of a rotatable strip and a notebook back binding.
Figure 7:
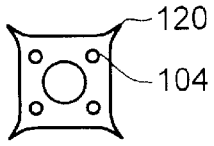
FIG. 7 is a bottom (inside) plan view of an indexing female clasp of the swivel attachment of FIG. 6.

Looking more particularly at the swivel attachment of FIG. 6, it includes a pivot pin 108, a washer 110, a female clasp 112, a male clasp 114, and a retainer 116. The pivot pin 108 passes through concentric bores in the washer 110, the back binding 22 of the book cover, the female clasp 112, the male clasp 114, the rotatable strip 32, and the retainer 116. The bore of the retainer 116 is shaped to have tabs which lock on the end of the pin 108 and thereby retain the washer 110, the back binding 22, the female clasp 112, the male clasp 114, and the rotatable strip 32 clamped between the retainer 116 and a head 118 of the pivot pin 108. As can be seen in FIG. 6, the female clasp 112 is stamped to have indexing indentations 104 therein while the male clasp 114 is stamped to have indexing protrusions 102 which are positioned for snapping into the indexing indentations 104 of the female clasp 112. It is noted that each of the female and male clasps 112 and 114 includes barbs 120 thereon for respectively digging into the back binding 22 and the rotatable strip 32 so as to prevent relative movement between the female clasp 112 and the back binding 22 and the male clasp 114 and the rotatable strip 32. Again, it should be understood that the rotatable strip 32 could be mounted on the book cover by the swivel attachment at different places (see FIG. 4). The pivot pin 108 can be inserted from either direction.

Figure 8:
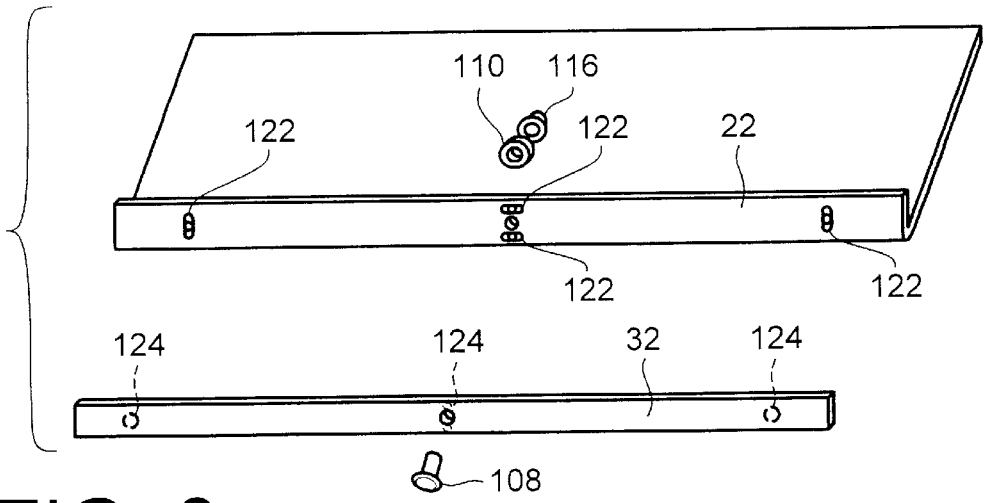
FIG. 8 is an isometric, exploded, cutaway view of another swivel attachment along with a rotatable strip and a notebook back binding but with the swivel attachment not being part of the indexing mechanism of this invention, rather the indexing mechanism being on the notebook back binding and the rotatable strip.

FIG. 8 also discloses an embodiment in which the rotatable strip 32 is mounted directly on a back binding 22 by a pivot pin 108, a retainer 116 and a washer 110, but in this case there are no male and female clasps 114, 112. In this embodiment, separate spring loaded ball bearings 22 are mounted on the back binding 22 to serve as protrusions. These ball bearings 122 are positioned to engage in indexing indentations 124 in the rotatable strip 32. Again, it should be understood that these spring loaded ball bearings 122 could be positioned almost anywhere on the book cover so long as the rotatable strip 32 is correspondingly mounted so that its indentations 124 snap onto the ball bearings 122. Also, other types of protrusions could be used for indexing. Further, indentations can be provided by separate elements mounted on the rotatable strip 32 of course, the indexing protrusions and indentations can be reversed, with the indexing indentations being mounted on the book cover.

It should be appreciated by those of ordinary skill in the art that the book stiffener mechanism, with the indexing mechanism, of this invention, in all embodiments, are uncomplicated and inexpensive to manufacture but yet provide an extremely useful function of stiffening a lose-leaf notebook, or other book, so that the book can virtually be used as a lap desk. The indexing mechanism ensures that the rotatable strip 32 does not inadvertently move from the stiffening and disabled positions when it is placed in those positions, so that the rotatable strip 32 does not become a nuisance.

While the invention has been particularly shown and described with reference to preferred embodiments, it should be understood by those skilled in the art that various changes in form and detail may be made therein without departing from the spirit and scope of the invention. For example, the indexing protrusions and indentations can be formed and arranged in many different ways. Further, the mounting strip can be a very small member and need not be elongated. Also, the indexing mechanism of this invention can provide index positions other than those described above.

I claim:

1. A book stiffener to be attached to a book cover having front and rear flap covers and an elongated back binding for stiffening the book when it is in an open configuration, said book stiffener comprising:

a relatively flat, thin, mounting strip and an attachment member for fixedly attaching said mounting strip to an outside surface of the book cover in a first plane, said mounting strip having a length which is not substantially greater than a height of said book cover;

an elongated, rigid, rotatable strip having a length dimension greater than a width of said back binding of said book for being positioned in a second plane, immediately adjacent to and parallel with said first plane;

a swivel attachment for attaching said rotatable strip to said mounting strip so as to allow rotation of said rotatable strip in said second plane relative to said mounting strip;

wherein is further included an indexing mechanism between said mounting strip and said rotatable strip for holding said rotatable strip in at least one predetermined, angular, index position relative to said mounting strip;

wherein the indexing mechanism comprises a protruding member on a first one of said mounting and rotatable strips, and an indentation on a second one of said mounting and rotatable strips, with said protruding member sliding against said second one of said mounting and rotatable strips before said protruding member reaches said indentation and then snapping into said indentation at said index position;

whereby said mounting strip includes means for attaching it to a rear surface of said book cover and said rotatable strip can be rotated to a stiffening position in which it extends across hinge seams of said front and rear flap covers with said back binding to thereby impinge upon the front and rear flap covers to prevent them from being opened substantially beyond a plane of said rotatable strip and to a disabled position in which it extends more nearly parallel with said back binding so it does not substantially extend across hinge seams between said front and rear flap covers.

2. The book stiffener of claim 1 wherein said index position is said stiffening position.

3. The book stiffener of claim 1 wherein said index position is said disabled position.

4. The book stiffener of claim 1 wherein said indexing mechanism is for holding said rotatable strip in predetermined, angular, first- and second-index positions relative to said mounting strip, said first-index position being said stiffening position and said second-index position being said disabled position.

5. A selectively stiffened book comprising:

a book cover having front and rear flap covers respectively attached to opposite sides of an elongated back binding at hinge seams, said front an rear flap covers being rotatable to positions in which they are almost in a common plane with each other and with the book binding;

a book stiffener mechanism comprising an elongated, rigid, rotatable strip having a length dimension substantially greater than a width of said back binding of said book, said book stiffener mechanism comprising a swivel attachment for attaching said rotatable strip to a rear surface of said book cover with said rear surface lying in a first plane and said rotatable strip ling in a second plane immediately adjacent to and parallel with said first plane so as to allow rotation of said rotatable strip in said second plane relative to said rear surface such that said rotatable strip is rotatable to a stiffening position in which it extends across hinge seams to thereby impinge upon the front and rear flap covers when they are opened to prevent them from being opened substantially beyond said common plane and to a disabled position in which it extends more nearly parallel with said back binding so as not to substantially extend across said hinge seams;

wherein is further included an indexing mechanism between said mounting strip and said book cover for holding said rotatable strip in a predetermined, angular, index position relative to said book cover;

wherein the indexing mechanism comprises a protruding member on a first one of said rotatable strip and said book cover, and an indentation on a second one of said rotatable strip and said book cover, with said protruding member sliding against said second one at said mounting and rotatable strips before said protruding member reaches said indentation and then snapping into said indentation at said index position.

6. The book stiffener of claim 5 wherein said index position is said stiffening position.

7. The book stiffener of claim 5 wherein said index position is said disabled position.

8. The book stiffener of claim 5 wherein said indexing mechanism is for holding said rotatable strip in predetermined, angular, first- and second-index positions relative to said book cover, said first-index position being said stiffening position and said second-index position being said disabled position.

9. The book stiffener of claim 5 wherein the indexing mechanism comprises a plurality of protruding members on one of said rotatable strip and said book cover, and a plurality of indentations on the other of said rotatable strip and said book cover, with protruding members snapping into indentations at said index position.

* * * * *